United States Patent [19]

Buisson

[11] 4,414,735

[45] Nov. 15, 1983

[54] PROCESS FOR MAKING CONDUCTOR ELEMENT WITH DOUBLE CONTACT FACE

[75] Inventor: Raymond Buisson, Chabeuil, France

[73] Assignee: Crouzet, Paris, France

[21] Appl. No.: 254,852

[22] Filed: Apr. 16, 1981

[30] Foreign Application Priority Data

Apr. 16, 1980 [FR] France ..... 80 08506

[51] Int. Cl.[3] ..... H01R 43/02

[52] U.S. Cl. ..... 29/879; 200/275

[58] Field of Search ..... 200/275; 29/882, 564.6, 29/876, 879, 874; 228/170

[56] References Cited

U.S. PATENT DOCUMENTS 2,373,861 4/1945 Van Inwagen .

3,432,925 3/1969 Wooley ..... 29/882

3,803,694 4/1974 Hermann et al. ..... 29/564.6 X 4,259,557 3/1981 Takano ..... 200/275

FOREIGN PATENT DOCUMENTS 857251 11/1952 Fed. Rep. of Germany ..... 29/874

1303663 8/1961 France ..... 200/275

*Primary Examiner*—Howard N. Goldberg

*Assistant Examiner*—Carl J. Arbes

*Attorney, Agent, or Firm*—Jacobs & Jacobs

[57] ABSTRACT

Metal section for making a conductor element with double contact face, adapted to be cut into portions, or electrical contacts.

This section comprises a base arranged to abut and be fixed on a face of the conductor element, and a body, extending on either side of the base, and having two opposite contact surfaces.

6 Claims, 2 Drawing Figures

PROCESS FOR MAKING CONDUCTOR ELEMENT WITH DOUBLE CONTACT FACE

Figure 2:
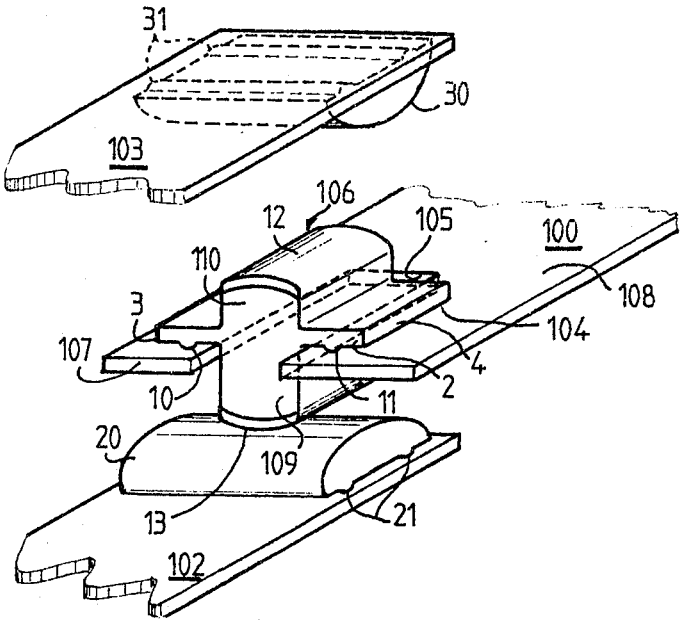

The present invention relates to conductor element, which is for example mobile, of a two-way switch assembly, the mobile element being provided with two electrical contact surfaces disposed in order respectively to cooperate alternately with one and the other of two contact surfaces respectively arranged on two fixed conductor supports, disposed on either side of the mobile element.

It is already known to produce such mobile conductor elements from a conductor strip and a multimetallic, for example, bimetallic, section, comprising a contact layer, for example made of precious metal or alloy, and a base layer made of ordinary metal, offering a good weldability with the material of the mobile strip, by cutting out two portions from the section and welding on each of the faces of the strip a portion of section, by its base layer of ordinary metal.

Although bimetallic and especially trimetallic sections enable the quantity of precious metal necessary for good electrical reliability of the contacts to be reduced as much as possible, the use of a double automatized equipment for supplying, cutting and welding two sections, for the two faces of the mobile switch strip, always remains prejudicial to the economy and reliability of such processes of production.

It is an object of the present invention to reduce further the production costs of the conductor elements of switches, and in particular of the mobile elements.

To this end, the present invention relates firstly to a metallic section for making a conductor element with a double contact face, adapted to be cut into portions or electrical contacts, characterized in that it comprises a base arranged to abut and be fixed on a face of the conductor element, and a body, extending on either side of the base and presenting two opposite contact surfaces.

Due to the two contact surfaces of the section of the invention, contact studs or portions, or contacts, with double active face, may be obtained, which may be welded onto conductor elements with the aid of simple automatized equipment.

The invention also relates to a switch conductor element with double contact, characterized in that a slot or notch is arranged in the conductor element, said notch being adapted to receive one of the two parts of the body of a portion cut from the section of the invention extending on one side of the base, the base abutting and being fixed on the face of the conductor element opposite the one which faces the part of the body received in the notch.

In addition, the invention also relates to a process for making a switch conductor element with double contact, characterized in that it comprises the steps of cutting out a portion from a section of the invention with double active face, cutting a notch in the conductor element, introducing the portion into the notch until its base abuts on the conductor element and fixing the base on the element.

Such a process offers the advantage of being particularly simple and inexpensive to carry out.

Figure 1:
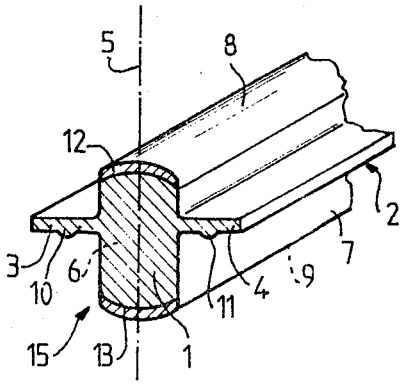

The invention will be more readily understood on reading the following description with reference to the accompanying drawings, in which:

FIG. 1 shows a view in perspective of a particular embodiment of the section of the invention with double active face, and FIG. 2 shows a view in perspective of a particular embodiment of the conductor element of the invention, provided with a portion of the section of FIG. 1.

Referring now to the drawings, the section 15 shown in FIG. 1 is adapted to be cut into portions which will be fixed, or even better welded, on a fixed or preferably mobile element, of a two-way switch which will be described hereinbelow.

This section comprises a central body 1, of substantially rectangular cross section, and a base 2. The base 2 is constituted by two flanges 3 and 4, in line with each other, and disposed perpendicularly to the plane of symmetry 5 of the section 15, projecting from the side walls 6,7 of the section 15. The two contact edges 8 and 9 of the body 1, perpendicular to the walls 6,7 are substantially convex for reasons which will be given hereinbelow. The two flanges 3 and 4 extend at a level of the body 1 located between the two edges 8 and 9 but nearer the edge 8 than edge 9, so that the difference between the distance from the edge 9 to the face of the flanges 3 and 4 facing this edge 9 and the distance from edge 8 to the face of the flanges 3 and 4 facing this edge 8, is virtually equal to the thickness of a conductor element adapted to receive a portion of the section 15.

The face of the flanges 3 and 4 turned towards the more remote edge 9 comprises at least one weld boss 10,11. The thickness of the flanges 3 and 4 is relatively small in order to be able to weld them on a conductor element, but is sufficient to ensure the mechanical connection between a portion of section and this conductor element.

The body and the base of the section 15, which therefore has a substantially cruciform section, are formed of a first ordinary metal material, offering a good weldability with the material of the conductor support elements. This may be copper, nickel or any other like metal or alloy. At least one second metal material covers the ordinary metal material of the section 15, on the edges 8 and 9, for example by lamination, and over a very small thickness, in order to form two thin superficial layers 12 and 13, adapted to ensure the electrical switching contact. These layers 12 and 13 are made of precious metal, or alloy of precious metal, for example silver. The section 15 as described hereinabove is a bimetallic section. However, it should be noted that the invention relates to a multimetallic, for example bimetallic or trimetallic, section. In the case of a trimetallic section, the superficial layers of precious metal may be of even smaller thickness than in the case of a bimetallic section, of the order of about ten microns.

FIG. 2 shows a mobile conductor element 100 with double contact face of a two-way switch assembly, further comprising two fixed conductor supports 102 and 103, disposed on either side of the blade 100.

The blade 100 is constituted by a conductor support strip adapted to occupy, alternately, two stable positions in abutment against one and the other of the two conductor supports 102 and 103.

At the free end 107 of the strip 100 is made a notch or slot 105, for example by being cut out, of width equal to or slightly greater than the width of the body 1 of the section 15, and of length equal to or greater than the length of the portion 106 previously cut from the section 15 and received on the strip 100. The notch 105 is preferably disposed longitudinally with respect to the strip 100, on either side of the median plane of the strip, and extends to end 107 of the strip or blade.

The part of the body 109 of the portion 106 comprising the layer of precious metal 13 more remote from the flanges 3 and 4 passes through the notch 105, so that the flanges 3 and 4 are in abutment against the face 108 of the strip 100 opposite this layer 13 and so that the two parts 109 and 110, projecting respectively from the flanges 3 and 4 and from the strip 100, of the body of the portion 106 have the same height, or thickness.

The mobile conductor element with double contact, or double active face, of FIG. 2, is made as follows:

After having cut the portion 106 from the section 15 with the aid of simple automatized equipment, and cut out the notch 105 in the strip 100, the portion 106 is introduced into the notch 105 until the base 2 of the portion 106 comes into abutment on the edges of the notch 105 of the strip 100, and the two flanges 3 and 4 are fixed to the strip 100, preferably by a double electro-resistive weld, at the level of the weld bosses 10 and 11, to ensure the mechanical and electrical connection of the portion 106 and the strip 100.

Contact studs 20 and 30 respectively are welded on the fixed conductor support elements 102 and 103. They are each constituted, in known manner, by a portion of a simple section, for example bimetallic, and slightly convex in their contact part of precious metal, opposite their weld surface, itself provided with weld bosses (21,31).

The studs 20 and 30 are disposed to cooperate alternately with the layer 12 and the layer 13 of the stud 106 of the mobile strip 100. In this respect, the studs 20 and 30 are disposed at right angles to stud 106, so that, the three studs in question having convex contact surfaces, their cooperation in two's makes a punctual contact of considerable electrical reliability.

What is claimed is:

1. A process for making a conductor element having a movable conductor blade and a double contact carried by the blade, which comprises cutting out a multimetallic portion from a prefabricated section, said portion having a pair of contacts thereon; cutting out a notch in one end of said blade; introducing said portion into said notch, whereby said portion extends away from opposite sides of said blade; abutting said portion against the edges of said notch; and securing said portion to said blade with said contacts on either side of said blade.

2. The process according to claim 1, wherein said portion has a central base portion and flanges projecting away from opposite sides of said base, and said base portion is abutted against said edges of said notch.

3. The process according to claim 2, wherein said portion is secured to said blade by securing said flanges to said blade.

4. The process of claim 3, wherein said securing is by electro-resistive welding.

5. The process of claim 2, wherein said securing is by electro-resistive welding.

6. The process of claim 5, wherein said securing is by electro-resistive welding.

* * * * *

UNITED STATES PATENT AND TRADEMARK OFFICE

CERTIFICATE OF CORRECTION

PATENT NO. : 4,414,735
DATED : November 15, 1983
INVENTOR(S) : RAYMOND BUISSON

It is certified that error appears in the above-identified patent and that said Letters Patent are hereby corrected as shown below:

Column 4, line 18, change "base" to --body--.

line 19, change "base", first occurrence only, to --body portion--.

change "base, second occurrence only, to --body--.

line 22, before "portion" insert --body--.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*